US005638041A

United States Patent [19]

Beyer et al.

[11] Patent Number: 5,638,041

[45] Date of Patent: Jun. 10, 1997

[54] ELECTROMAGNETIC ASSEMBLY

[75] Inventors: Wilfried Beyer, Eutin; Thorsten Krause, Plön, both of Germany

[73] Assignee: Kuhnke GmbH, Malente, Germany

[21] Appl. No.: 480,940

[22] Filed: Jun. 7, 1995

Related U.S. Application Data

[63] Continuation of Ser. No. 168,469, Dec. 6, 1993, abandoned.

[30] Foreign Application Priority Data

Dec. 24, 1992 [DE] Germany ..... 42 44 247.8

[51] Int. Cl.[6] ..... H01F 7/10

[52] U.S. Cl. ..... 335/245; 310/172

[58] Field of Search ..... 335/245; 310/172, 310/182, 183, 187, 193

[56] References Cited

U.S. PATENT DOCUMENTS

| | | |
|---|---|---|
| 1,370,914 | 8/1921 | Rippl . |
| 2,076,857 | 4/1937 | Morgenstern . |
| 4,200,972 | 5/1980 | Katchka . |

FOREIGN PATENT DOCUMENTS

| | | |
|---|---|---|
| 134740 | 9/1933 | Austria . |
| 2014987 | 4/1970 | France . |
| 2272472 | 12/1975 | France . |
| 951511 | 10/1956 | Germany . |
| 1295084 | 5/1969 | Germany . |
| 1539918 | 10/1970 | Germany . |
| 519231 | 2/1972 | Switzerland . |

*Primary Examiner*—Lincoln Donovan
*Attorney, Agent, or Firm*—Dvorak and Traub

[57] ABSTRACT

An electromagnetic assembly, for example for a relay, has a magnetic core surrounded by an electrical coil, and an armature closing the magnetic circuit of the electromagnetic assembly. The magnetic core is of the split pole type having a first pole and a second pole, the former being surrounded by a shading ring to produce a phase shift in the magnetic flux in the region of the poles when the electrical coil is energized. A step is provided in the first pole between the shading ring and the armature so that the flux density, and thus the magnetic force, between the first pole and the armature is increased.

8 Claims, 4 Drawing Sheets

ELECTROMAGNETIC ASSEMBLY

The present application is a continuation application of U.S. application Ser. No. 08/168,469 filed on 16 Dec. 1993 entitled Electromagnetic Assembly, now abandoned.

BACKGROUND OF THE INVENTION

This invention relates to an electromagnetic assembly comprising an electrical coil having a magnetic core which is of the split pole type in which one of at least two poles is surrounded by a shading ring. An armature arranged opposite to the poles and has a yoke which closes the magnetic circuit of said assembly.

Such electromagnetic assemblies are used in many fields of technology, for example, in state-of-the-art relays driven by means of alternating current. Dividing the core opposite to the armature into two or more poles, one of which is surrounded by a shading ring, serves to produce a phase shift in the magnetic flux in the region of the two poles, when the electrical coil is energized. Said phase shift prevents interruption of the magnetic retaining force between core and armature when the alternating current changes direction. Such electromagnetic assemblies are described for example in German Patent Specifications 141 026B1 and 539 918B1.

In order to produce as great a possible magnetic force between the poles and the armature, in split-pole cores of laminated construction, the area surrounded by the shading ring should be as large as possible, so that, the magnetic resistance via that flux path is kept low. By virtue of this expedient favourable flux conditions and also favourable output conditions with respect to the phase shift between the two partial fluxes can be obtained. The core must, however, be laminated in order to achieve homogeneous magnetic field distribution. Effective magnetic field displacement will not occur if the laminations are of suitable thickness since the eddy currents in the core laminations will be very small.

For manufacturing reasons alone, however, it is desirable to use in alternating current relays, for example, unlaminated cores when the cores exceed a given size. Magnetic field displacement caused by eddy currents induced in the unlaminated core, results in low depth of penetration of the magnetic field, with associated non-homogeneous magnetic field conditions in the immediate environment of the poles. Such conditions adversely affect the magnetic forces exerted between the poles and the armature, since the flux densities over the pole surfaces thus also depend on location and vary.

As the pole surface area surrounded by the shading ring is relatively large, the effect of said field displacement is substantial.

SUMMARY OF THE INVENTION

An object of the invention to provide an electromagnetic assembly of the kind under discussion in which the disadvantageous effects mentioned above are avoided, or are at least reduced, so that higher magnetic retaining forces between poles and armature are obtained.

According to one aspect of the invention the shaded pole surrounded by the shading ring is adapted to increase the flux density between the shaded pole and armature, in that the end face of the shaded pole, opposite to the armature is smaller than its cross-sectional area in the region of the shading ring to an extent to increase said flux density.

This achieves a local increase in flux density in the region of the shaded pole, the relative permeability also being lowered which augments the depth of penetration of the magnetic field.

The detailed dimensioning of the pole surfaces may be determined by computer and/or empirically. The cross-sectional area of the shaded pole may however be reduced only in so far as the saturation limit of the magnetic material is just reached, if the positive magnetic force conditions are not to be impaired. A significant increase in flux density to obtain the desired increase in the magnetic retaining force is provided if the ratio of the surface area of the end face of the shaded pole to the total cross-sectional area of that pole is smaller than or equal to 0.7.

Although the shaded pole may be chamfered so that the end face of the shaded pole is smaller than the cross-sectional area of that pole in the region of the shading ring, purely for easier assembly of the shading ring, such chamfering can result only in negligible changes in the magnetic force conditions. According to the preferred embodiment of the invention a step is provided in the shaded pole, in order to achieve the desired flux density. Theoretically, the magnetically active surface of the shaded pole could also be altered by unilateral or circumferential chamfering of the shaded pole towards its front end, but practical requirements are against such a step. In order to provide the increase in magnetic force between shaded pole and armature, said increase in magnetic flux density is critical. Such increase is, however, desirable only in the immediate vicinity of the shaded pole, if the magnetic resistance and hence also the drop in magnetic potential difference is not to be increased to an intolerable extent. The pull-increasing effect on the armature can thereby be obtained only inadequately by the use of such chamfering, or by setting the shading ring substantially further back, which, as is known, is disadvantageous.

By virtue of the stepped configuration of the shaded pole in the region between shading ring and armature, the effective area of the shaded pole in this region is so reduced that the total magnetic flux in the shaded pole is concentrated in the reduced cross-section part thereof. Thus, almost homogeneous magnetic field conditions are produced, which are disturbed only by the three-dimensionality of the magnetic return. The local increase in flux density produces an increase in the magnetic force despite the decrease in the area of the shaded pole, as the magnetic force increases by the square of the flux density.

Although the active cross section of the unshaded pole may be reduced towards the armature by chamfering, this serves exclusively to adjust the desired flux conditions.

More than two shaded and unshaded poles may be provided. Where the core is of circular cross section the end faces of the poles may be concentric annular surfaces. the shading ring being then located within an annular groove formed in the end face of the core. The step in the shaded pole can then be simply produced by providing a central blind hole in the end face of the core, the depth of which hole is less than that of the annular groove for the shading ring.

The core need not necessarily be solid but may be laminated. Preferably, however, the core is a one-piece solid core.

The above-mentioned increase in the magnetic force in the region between shaded pole and armature is obtained by the selective increase in the magnetic flux in that region. According to another aspect of the invention said increase in the magnetic force can also be achieved by means of a corresponding configuration of the armature in the region opposite to the poles. To this end the active magnetic surface area of the armature in its region opposite to the shaded pole is reduced so as to concentrate the magnetic flux, in such a way that the magnetically active end face of the armature in this region is smaller than the magnetically active end face of the shaded pole.

According to one embodiment the armature comprises a raised end face which faces towards the shaded pole and is opposite thereto but is smaller than the active end face of that pole.

In the interests of simple design and manufacture, however, according to another embodiment, the armature is shortened, so that its magnetically active surface opposite to the shaded pole is smaller than the active end face of that pole.

Embodiments of the present invention will now be described by way of example with reference to the accompanying drawings which are greatly simplified.

DETAILED DESCRIPTION OF THE EMBODIMENTS OF THE INVENTION

Figure 1:
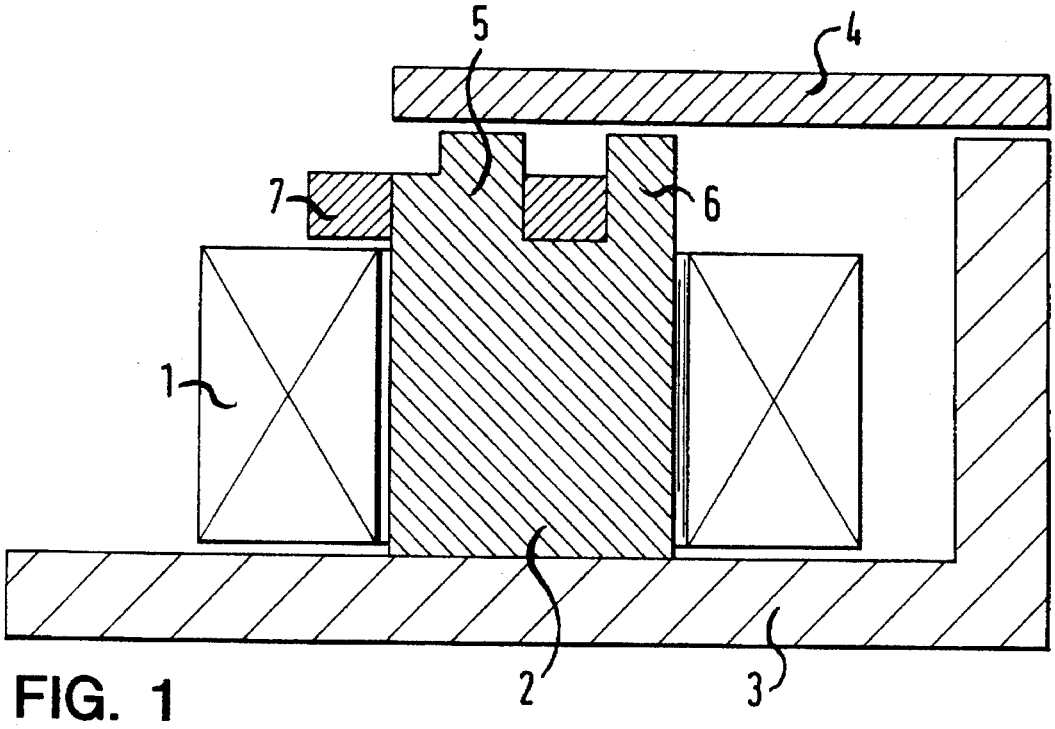
FIG. 1 is a longitudinal section view of an electromagnetic assembly according to a preferred embodiment of the invention.

The preferred embodiment of the invention will now be described with reference to FIGS. 1 to 3. As shown in FIG. 1, an electromagnetic assembly, which may, for example, be part of an electromagnetic alternating current relay, comprises a generally cylindrical magnetic core 2 of high magnetic permeability material, an electrical coil 1 surrounding the core 2, and an armature 4 also made of a material of high magnetic permeability. The magnetic circuit of the assembly consists of the core 2, the yoke 3 and the armature 4. The yoke 3 is substantially L-shaped, as seen in FIG. 1, one arm of the yoke 3 extending transversely of the core 2 which is seated thereon, and the other arm of the yoke 3 extending parallel to the longitudinal axis of the core 2. The magnetic circuit of the electromagnetic assembly is closed by way of respective small gaps between the top of said parallel arm of the yoke 3 and the armature 4, and between the end of the core 2 remote from said transverse arm of the yoke 3.

When the coil 1 is energised, magnetic flux flows in the magnetic circuit so that the armature 4 is pulled against the magnetic core 2, so that, for example, a relay is opened or closed, as the case may be, by means of the armature 4.

In order to prevent the magnetic force retaining the armature 4 against the top of the core 2, when the coil 1 is energized by alternating current, from being interrupted by reversal of the direction of the magnetic field, caused by the periodic reversal of the voltage applied to the coil 1, the upper end of the core 2 is provided with a first pole 5 and a second pole 6. That is to say the core 2 is constructed as a split-pole core. The first pole 5 is completely surrounded by a shading ring 7 to produce a phase shift of the magnetic flux, and will, therefore, be referred to as "the shaded pole". By virtue of said phase shift, it is ensured, as is well known in the art, that when the direction of the magnetic flux is changed, the magnetic force holding the armature 4 against the core 2 is not eliminated during the brief zero current interval.

Figure 2:
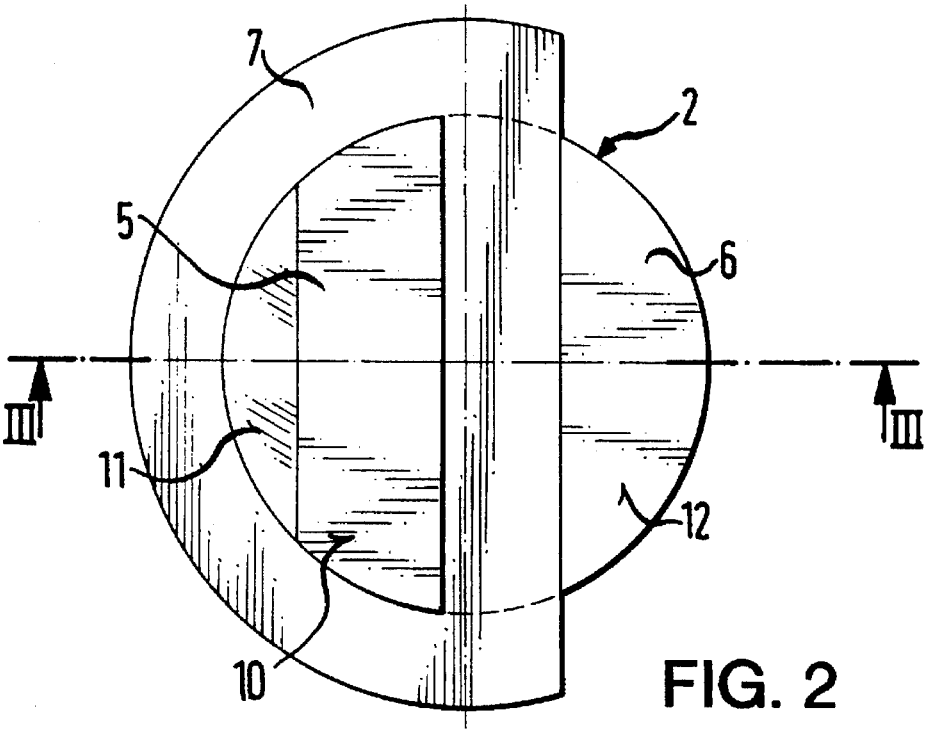
FIG. 2 is an enlarged top plan view of the magnetic core of an electrical coil of the assembly.
Figure 3:
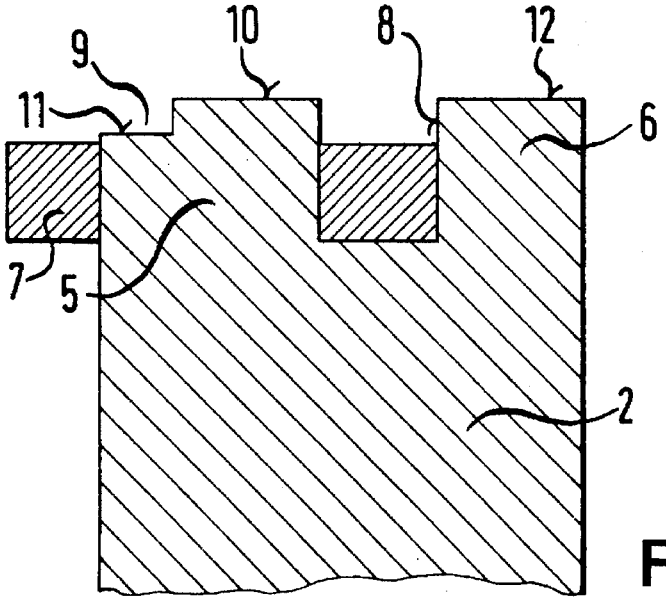
FIG. 3 is a fragmentary sectional view taken to the lines III—III of FIG. 2.

As seen in top plan in FIG. 2, the shading ring 7 is D-shaped and is received in a groove 8 (FIG. 3) in the top of the core 2 so as to surround the shaded pole 5 over its full circumference. Since the depth of the groove 8 substantially exceeds the height of the ring 7, the ring 7 is correspondingly spaced from the armature 4. The shaded pole 5 is formed with a step 9 so that the pole 5 is provided with two upper end faces 10 and 11, respectively, spaced at different distances from the armature 4. The end face 11 at the bottom of the step 9 is parallel to the face 10 between the face 10 and the shading ring 7. By virtue of the step 9 the concentration of the magnetic flux in the region of the armature 4, and thus the magnetic force urging it towards the end face 10, is augmented. Since this increase in flux density occurs only in a relatively short region of the shaded first pole 5, between the shading ring 7 and the armature 4, the drop in magnetic potential difference caused by the higher magnetic resistance in said region is comparatively small.

Irrespective of the step 9, the shaded pole 5 may be provided at its upper peripheral edge with a joining chamfer. The end face 12 of the unshaded pole 6, may similarly be reduced by laterally chamfering the pole 6 to adjust the magnetic flux in the region thereof.

Another embodiment of the invention will now be described with reference to FIGS. 4 and 5, in which parts which are of the same, or which are of similar, effect to those described above bear the same reference numerals as the parts described above, but with the addition of the suffix "a"

Figure 4:
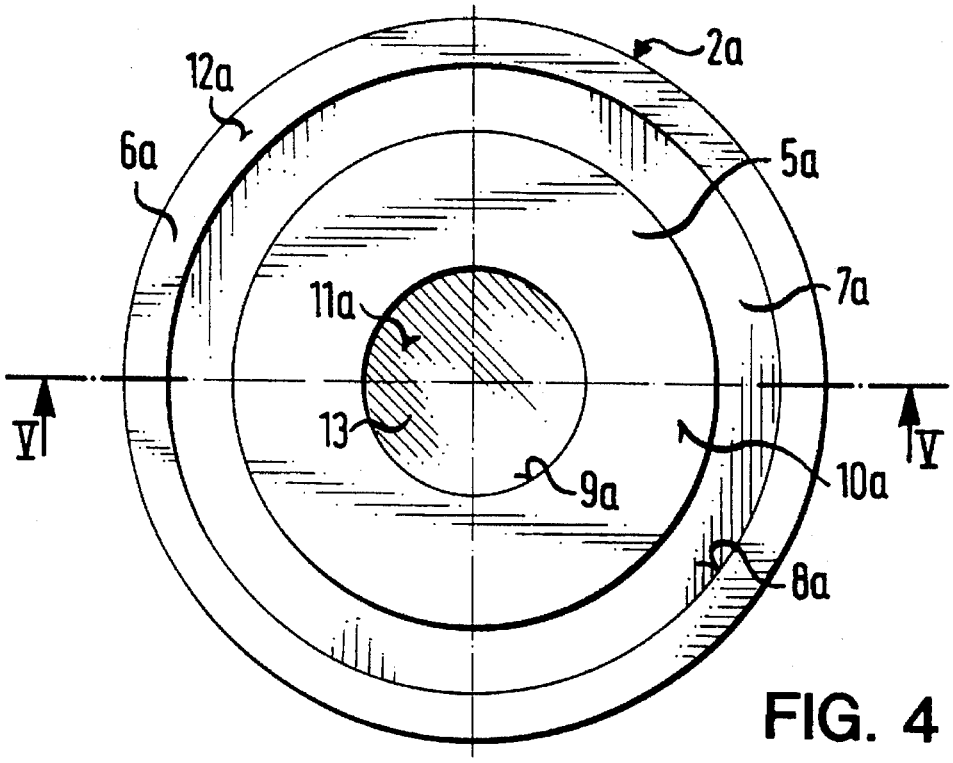
FIG. 4 is an enlarged top plan view of another embodiment of the magnetic core.
Figure 5:
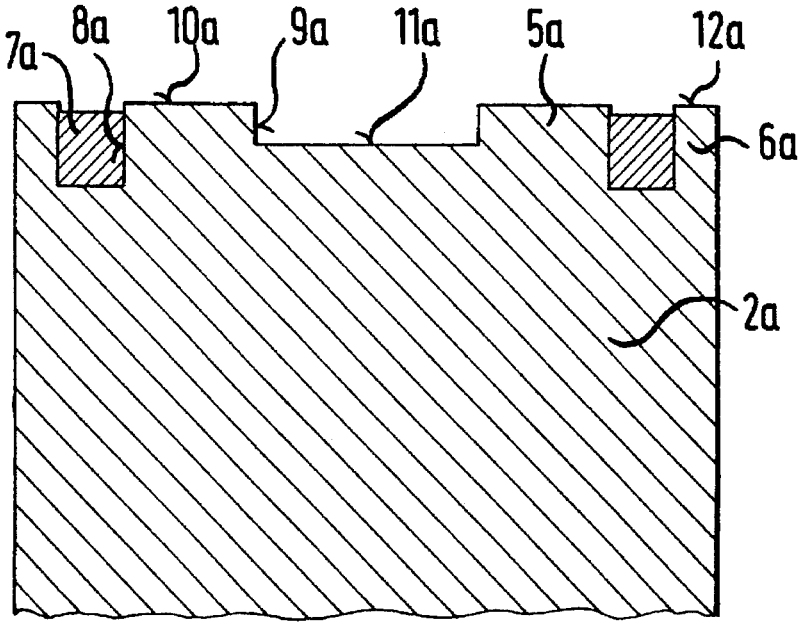
FIG. 5 is a fragmentary sectional view taken on the lines V—V of FIG. 4.

In the embodiment of FIGS. 4 and 5 the core 2*a* is also generally cylindrical. The top face of the core 2*a* is formed with an annular groove 8*a* receiving a circular shading ring 7*a* enclosing a central shaded pole 5*a*. A circular unshaded pole 6*a* surrounds the shading ring 7*a*, concentrically therewith and with the shaded pole 5*a*. A central, circular, blind hole 13 formed in the top end face 10*a* of the pole 5*a* defines a step 9*a*. The pole 5*a* has a set back end face 11*a* defined by the hole 13, the unshaded pole 6*a* having an annular end face 12*a* above, and parallel with, the end face 11*a*. The depth of the hole 13 is less than that of the groove 8*a*. The end face 10*a* is of substantially smaller cross section than the shaded pole 5*a* in the region of the shading ring 7*a* so as to increase the flux density in that region.

Figure 6A:
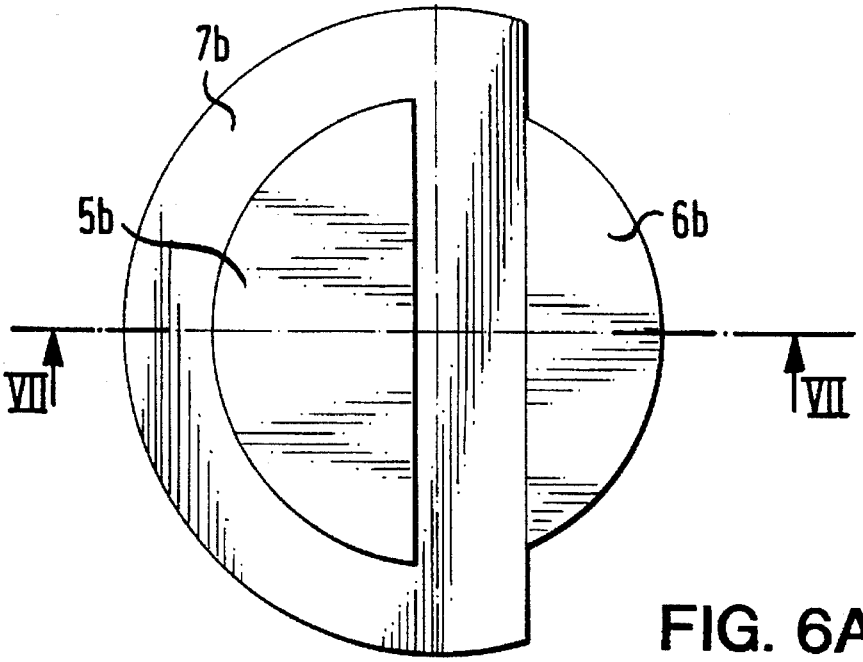
FIG. 6 is an enlarged top plan view of a conventional magnetic core of an electrical coil.
Figure 6C:
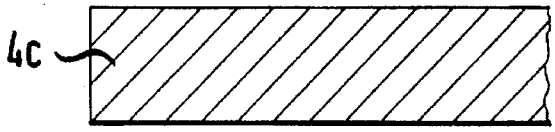
Figure 6B:
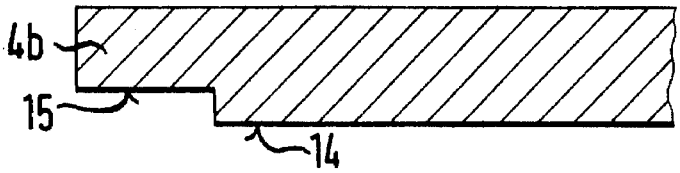
Figure 7:
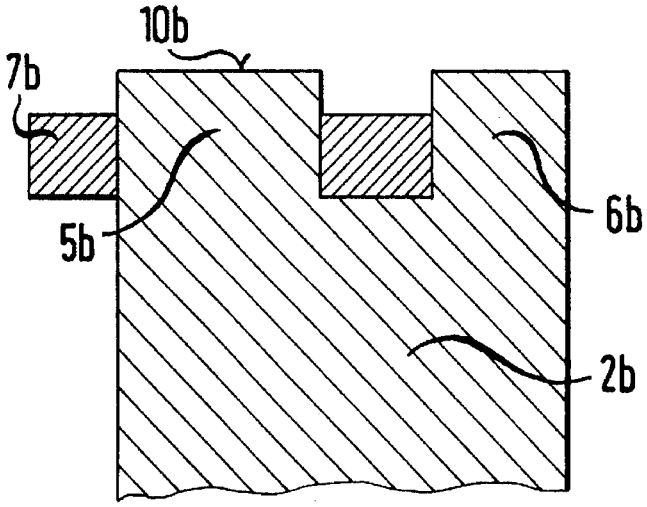
FIG. 7A is a fragmentary sectional view taken on the lines VII—VII of FIG. 6 and showing in fragmentary section and in conjunction with the magnetic core
FIGS. 7B and 7C show alternative embodiments of an armature of the electromagnetic assembly.

In the embodiments of FIGS. 6 and 7, parts which are of the same, or which are of similar, effect to those described with reference to FIGS. 1 to 3 bear the same reference numerals as those parts but with the addition of the suffix "b". The core 2*b* corresponds to the core 2 of FIGS. 1 to 3, excepting that the shaded pole 5*b* is unstepped according to known practice. The unshaded pole is referenced 6*b* and the shading ring is referenced 7*b*.

According to one embodiment, the magnetic flux density in the region between the poles and the armature 4*b* or 4*c* is augmented by reducing the active magnetic surface of the armature in the region of the top end face 10*b* of the shaded pole 5*b*. To this end the armature 4*b* is provided with a step 15 in its side 14 which faces towards the end face 10*b* of the shielded pole 5*b*. According to another embodiment, the armature 4*c* is not provided with a step but is shortened so that it lies opposite to only part of the end face 10*b* of the pole 5*b*. In this case, however, the increase in the magnetic force between the armature and the pole is less marked than in the other embodiments described above.

What is claimed is:

1. An electromagnetic assembly comprising:

an electrical coil having a magnetic core, the magnetic core having at least first and second poles, each pole having an end face;

a shading ring surrounding the first pole to produce a phase shift in the magnetic flux in the region of said poles when the electrical coil is energized;

an armature disposed opposite to said end face of said at least first and second poles;

a yoke forming a magnetic circuit including the electrical coil and the armature of the magnetic assembly;

the end face of the first pole facing the armature having an upper face and a lower face to increase the flux density between the first pole and the armature when the electrical coil is energized; and a step between the upper face and the lower face, the lower face being located along a corner of the end face of the first pole.

2. An assembly as claimed in claim 1, wherein the upper face is in closer proximity to the armature than the lower face.

3. An assembly as claimed in claim 1, wherein the at least first and second poles are separated by a recess in the magnetic core, said recess for receiving the shading ring.

4. An assembly as claimed in claim 1, wherein the end faces of the first and second poles, facing the armature are annular.

5. An assembly as claimed in claim 1, wherein the magnetic core is made in one piece, the shading ring being a part which is separate from the one-piece magnetic core.

6. An assembly as claimed in claim 1, wherein the ratio of an area of the upper face to the total area of the end face of the first pole is no greater than 0.7.

7. A magnetic core for an electrical coil, the core comprising at least first and second poles and means for supporting a shading ring surrounding the first pole, an end face of the first pole including an upper face and a lower face, a step between the upper face and the lower face, the lower face being located along an outside corner of the end face of the first pole.

8. A magnetic core as claimed in claim 7, wherein the ratio of the cross sectional area of the second end face with respect to the total cross sectional area of the first pole is no greater than 0.7.

* * * * *